United States Patent [19]

Hagger

[11] Patent Number: 4,723,366

[45] Date of Patent: Feb. 9, 1988

[54] TRACTION CLEAT WITH REINFORCED RADIAL SUPPORT

[75] Inventor: Leonard D. Hagger, Wayland, Mass.

[73] Assignee: MacNeill Engineering Company, Inc., Marlborough, Mass.

[21] Appl. No.: 898,600

[22] Filed: Feb. 5, 1985

[51] Int. Cl.[4] ..... A43B 5/00; A43C 15/16

[52] U.S. Cl. ..... 36/134; 36/127; 36/67 D

[58] Field of Search ..... 36/127, 134, 67 A, 67 D, 36/62, 65

[56] References Cited

U.S. PATENT DOCUMENTS

| | | | |
|---|---|---|---|
| 2,787,843 | 4/1957 | Phillips | 36/67 D |
| 3,552,043 | 1/1971 | Moffa | 36/67 D |
| 3,685,174 | 8/1972 | Granger Jr. | 36/67 R |
| 3,715,817 | 2/1973 | White et al. | 36/67 D |
| 3,828,364 | 8/1974 | Aoyama | 36/67 B |
| 4,063,372 | 12/1977 | MacNeill | 36/127 |
| 4,146,979 | 4/1979 | Fabbrie | 36/127 |
| 4,193,216 | 3/1980 | Veda | 36/67 D |
| 4,240,215 | 12/1980 | Broussard | 36/67 D |
| 4,330,950 | 5/1982 | Reddien | 36/127 |
| 4,466,205 | 8/1984 | Corbari | 36/67 D |

FOREIGN PATENT DOCUMENTS

| | | | |
|---|---|---|---|
| 176911 | 9/1935 | Switzerland | 36/67 A |
| 2028102 | 3/1980 | United Kingdom | 36/134 |
| 2088196 | 6/1982 | United Kingdom | 36/134 |
| 2115683 | 9/1983 | United Kingdom | 36/134 |

*Primary Examiner*—Steven N. Meyers

*Attorney, Agent, or Firm*—Bromberg, Sunstein & Casselman

[57] ABSTRACT

A traction cleat for removable attachment to footwear includes a metal stud infrastructure with a vertical axis and two ends, the infrastructure further including a stem portion at the first end for attachment to a shoe, a head portion at the second end for tractive engagement with the ground, and a broad flange between the stem and head portions and extending radially outward from the vertical axis. A plastic skirt is molded directly upon the flange portion of the metal infrastructure, the resultant unitary skirt and flange forming the reinforced radial support member of the cleat.

7 Claims, 6 Drawing Figures

TRACTION CLEAT WITH REINFORCED RADIAL SUPPORT

TECHNICAL FIELD

This invention relates to a traction cleat for shoes, and in particular to a removable golf cleat.

BACKGROUND ART

Removable golf cleats are well known in the prior art. Generally, they include three main features, i.e., a ground-engaging tip, a radial support that firmly rests against the shoe outsole, and an uppermost stem for internal connection (usually by threaded engagement) with a mated socket within the shoe sole. One such receptacle is the subject of U.S. Pat. No. 4,306,360 to Hagger, disclosing an internally threaded receptacle including a plastic body and a metal threaded socket for incorporation into a molded body, e.g., a golf shoe sole. While many early cleats were made solely of metal material, suitably durable synthetics, e.g., hard rubbers or nylons, have been incorporated to varying extents to gain the advantages of lightness of weight, flexibility and attendant comfort in use, and rust-proofness Extensive use of such synthetics is exemplified in U.S. Pat. No. 2,697,288 to Wilcox, in which the entire cleat structure is uniformly plastic, save for a metal nib inserted at the tip of the ground-engaging head. However, such wholesale replacement of metal with plastic has significant drawbacks; the threaded plastic stem is weak, particularly at the small threadform size that has become standard in the industry, and tends to relax and deform with use, eventuating a looser fit and tendency to unscrew. As most internally threaded receptacles in golf shoes are provided with metal threads, the resultant metal-to-plastic threaded connection (on which there is necessarily much stress, as discussed below) exaggerates this weakness. In the extreme, the plastic threads can be stripped completely from the cleat stem.

U.S. Pat. No. 4,360,490 to Collins also discloses a cleat utilizing a plastic threaded stem, molded uniformly with a plastic support flange; however, the threadform here has been enlarged to a diameter substantially greater than that commonly used in golf cleats, and the plastic stem is made hollow for insertion of a metal pin element which, once inserted, is deformed and riveted over for attachment to the stem. However, while the larger threadform size adds some strength to the plastic stem, this construction eliminates the advantage of using threadforms of the standard, smaller size, while it does not significantly eliminate the tendency of plastic threads to deform when tightly engaged against metal. A further disadvantage lies with the need for ductility in the metal portion of the cleat (i.e., the thin, pin-insert end must be rolled, and then deformed and riveted over for attachment), forfeiting hardness in the ground-engaging head. In such a design, only the tip can then be point-hardened. Thus, the inventor believes that such cleat construction gives up more than it offers.

Other cleats have struck the compromise of retaining an all-metal column (i.e., stem and head portions), in cooperation with an all-plastic support flange. Such a design retains hardness in the head region, a high degree of resiliency in the support, and rust-proof protection by the support of the internal metal connection. However, the inherent challenge of such a design is achieving sufficient affixation of plastic flange to metal column as will tolerate the torque applied in insertion and removal of the cleat (e.g., with the use of special wrenches), the axial forces exerted in use, and the continual flexing of the support member relative to the rigid central column, without causing rupture or separation. Since the primary function of the radial support in a traction cleat is to receive and distribute these forces evenly, efficiently and without threat to cleat integrity, the column-support connection is a crucial one. In the cleat just described, the surface area of attachment, i.e. the metal column-plastic support interface, is localized on the metal column at the latitude of the support, with the result that the loads travelling up the cleat column are concentrated at this narrow junction, prior to their transfer to the support. Thus, the amount of stress at every point of transfer is necessarily greater than it would be were a broader, more stable surface area of attachment provided. The inefficient distribution of forces that results from this construction creates increased vertical rigidity, attendant discomfort to the wearer, potential damage to the integrity of the threaded receptacle, as well as threat of cleat rupture.

DISCLOSURE OF THE INVENTION

The present invention is a traction cleat for removable attachment to footwear, which includes a metal stud infrastructure at the core of the cleat, the infrastructure having a vertical axis and two ends, and further comprising a stem portion at a first end for engagement with a receptacle in the shoe, a head portion at a second end for tractive engagement with the ground, and a broad flange between the stem and head portions and extending radially outward from the vertical axis. A plastic skirt is molded directly upon the flange portion of the metal infrastructure, the resultant unitary skirt and flange forming the reinforced radial support member of the cleat. In a preferred embodiment, the flange member of the infrastructure is formed of individual, evenly-spaced leaf-like sections.

BRIEF DESCRIPTION OF THE DRAWINGS

These and other features of the invention will be more readily understood by consideration of the following detailed description, taken with the accompanying drawings, in which.

DESCRIPTION OF SPECIFIC EMBODIMENTS

Figure 1:
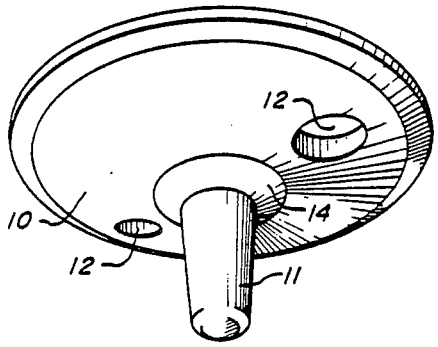
FIG. 1 is a perspective view from below of an embodiment of a traction cleat in accordance with the present invention.
Figure 2:
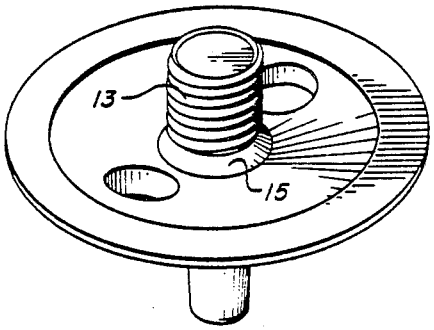
FIG. 2 is a perspective view from above of an embodiment of a traction cleat in accordance with the present invention.

FIG. 1 is a perspective view of a preferred embodiment of a traction cleat in accordance with the present invention as seen generally from below, displaying ground-engaging head 11 which is frusto-conical in shape, tapering progressively toward its generally rounded-off tip. Head 11 is formed of a suitably hard metal, further discussed below, which is then through-hardened and plated for increased wear resistance. External skirt 10, generally circular in shape, is made from a suitably durable and resilient synthetic, e.g., polyurethane. Skirt 10 is slightly domed, and is seen in FIG. 1 from its convex side, from which wrench-holes 12 also can be seen. FIG. 2 shows the same cleat embodiment as in FIG. 1, but from above, with threaded stem 13 extending from the other, concave side of skirt 10, skirt 10 separating head 11 from stem 13 along the vertical column which defines a longitudinal axis. Stem 13 is generally cylindrical, with a diameter roughly equal to the wider end of frusto-conical head 11.

Figure 3:
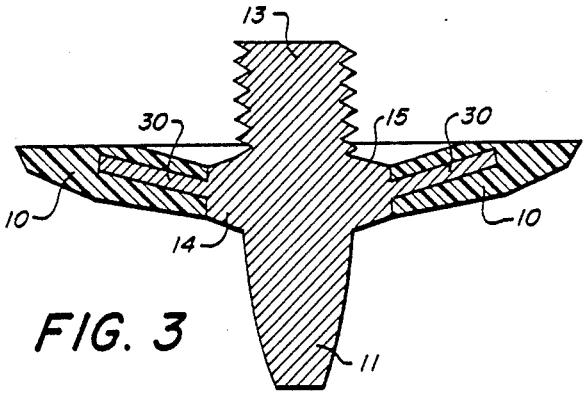
FIG. 3 is a view of a vertical section thereof.

FIG. 3 is a view of a vertical section of the cleat of FIG. 1, revealing broad, interior metal flange 30 which radiates from the vertical column in the region between head 11 and stem 13. Flange 30 is substantially encased within external skirt 10, is similarly cupped toward stem 13, and is generally circular in contour. Together, external skirt 10 and internal flange 30 form the dish-shaped, reinforced radial support structure of the cleat.

Figure 4:
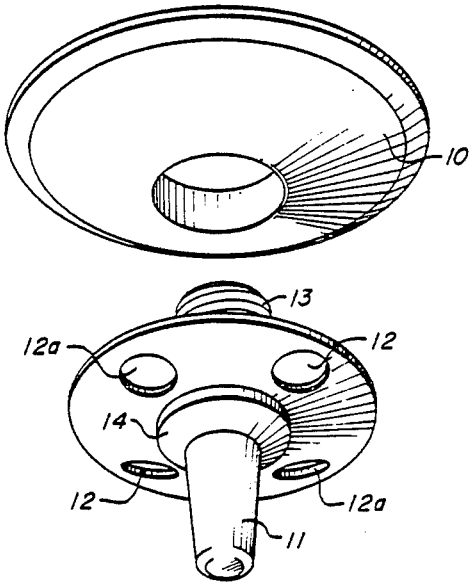
FIG. 4 is a perspective view from below thereof, with the outer skirt of the support removed and shown separately for the purpose of illustration.

FIG. 4 shows the unitary metal infrastructure of the present invention, separated from and situated below plastic skirt 10, the metal infrastructure including head 11, stem 13 and flange 30. In assembly, flange 30 and the central column piece are cold-formed into this unitary, miniature cleat, with the aid of collars 14 and 15 which lock flange 30 to the column. The column is preferably of high- or medium-carbon steel, and flange 30 of low-carbon steel. Once formed, the entire metal infrastructure is through-hardened and plated, preferably with zinc or cadmium, for extra durability. Stainless steel can be substituted in the column, although at greater expense, making the entire cleat rust-proof.

As mentioned in connection with FIG. 3, flange 30 is cupped slightly upward toward stem 13. In manufacture, external skirt 10 is then molded directly onto flange 30 by means well known in the art, and together with flange 30 forms the dome-shaped support of the cleat. Diametrically opposed wrench-holes 12 on flange 30 are retained during the molding of skirt 10, as seen in FIGS. 1 and 2, for use with a specially designed wrench in installing and releasing the cleat from a golf shoe. The remaining flange holes 12*a* serve as bonding holes for the molding of skirt 10 onto flange 30, and these are interrupted during the molding process.

Figure 5:
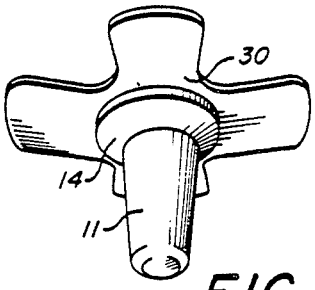
FIG. 5 is a perspective view from below of a further embodiment thereof, with the outer skirt of the support removed for the purpose of illustration.
Figure 6:
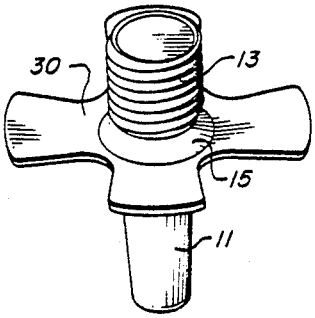
FIG. 6 is a perspective view from above of the further embodiment of FIG. 5, with the outer skirt of the support removed for the purpose of illustration.

FIGS. 5 and 6 depict an alternative configuration of flange 30 for a further embodiment of the invention, in which the flange is not generally circular, but is shaped as a squared-off cloverleaf, the leaves of which are slightly upturned toward stem 13, symmetrically spaced and onto which skirt 10 is molded as described above. This alternative cloverleaf design lends itself to automation, and is at least as efficient as the washer-type flange of FIG. 4 in receiving and transmitting the occupational stresses discussed. The cloverleaf design further obviates the need for distinct flange holes 12 and 12*a*. With the cloverleaf flange, wrench-holes 12 are formed in skirt 10 as before, and are then lined up with the interspaces between the individual panels of the cloverleaf; as for bonding holes 12*a* the synthetic material of the skirt 10 bonds as surely around the leaf-like protrusions as it does by means of the bonding holes.

In use, the traction cleat of the present invention is inserted into an internally threaded receptacle within the sole of an athletic shoe. Specifically, stem 13 is screwed into a mated receptacle, the length of which is at least substantially equal to the length of stem 13, until the perimeter of the concave surface of skirt 10 makes contact with the sole of the shoe. At this point, stem 13 has not been fully rotated up the length the threaded receptacle. With the aid of a wrench specifically designed for use with wrench-holes 12, the cleat can be screwed the remainder of the distance up the socket, encountering greater resistence with each rotation as the reinforced dish-shaped support (i.e., comprising flange 30 and skirt 10) is gradually flattened against the shoe sole. The resultant backforce, created by the tendency of the support to pull down on stem 13 in order to resume its natural dome-shape, creates a lock on the threads, discouraging any inclination of the cleat to unscrew during use. This action also keeps the rim of the support in firm and continuous contact with the shoe sole when the sole flexes during normal use, thereby helping to insulate the socket against invasion by moisture or foreign materials. These locking mechanisms are specifically enhanced by the metal-reinforced support, which offers a higher degree of firmness to the generally resilient cleat in use. Furthermore, the external plastic skirt keeps the support relatively lightweight, as well as rust-proof.

Moreover, the construction of the present cleat invention overcomes the problem of instability at the support-column connection of prior art cleats, discussed above. Since in the present invention interior flange 30 is integral with the vertical column, the axial forces traveling up from the head will be evenly transmitted about the metal flange, and, subsequently, further distributed to the plastic skirt via the metal-plastic interface.

Accordingly, while the invention has been described with particular reference to specific embodiments thereof, it will be understood that it may be embodied in a variety of forms diverse from those shown and described without departing from the spirit and scope of the invention as defined by the following claims.

What is claimed is:

1. A traction cleat for removable attachment to the underside of footwear, the cleat comprising:

(a) a metal infrastructure, having a vertical axis and first and second ends, the infrastructure including
   i. at the first end, engagement means for removable engagement with a mated receptacle,
   ii. at the second end, a ground-engaging head portion, and
   iii. a flange member extending radially outward from a region between the engagement means and the head portion along the vertical axis; and (b) a plastic flange-supporting skirt substantially encasing the flange member of the infrastructure, and forming with the flange member a reinforced radial support member such that forces acting on the bead portion are distributed across the flange and the plastic flange-supporting skirt when the engagement means is in engagement with the mated receptacle.

2. A traction cleat in accordance with claim 1, wherein the radial support member is dish-shaped, having concave and convex sides, and wherein the engagement means extends from the concave side thereof.

3. A traction cleat in accordance with claim 1, wherein the flange member includes a plurality of apertures disposed around the surface thereof to aid in the attachment of the plastic skirt thereto.

4. A traction cleat in accordance with claim 3, wherein the flange member is generally circular in shape.

5. A traction cleat in accordance with claim 1, wherein the flange member is non-circular, and is instead formed of a plurality of distinct, evenly-spaced leaf-like panels.

6. A traction cleat in accordance with claim 1, wherein the engagement means includes an externally threaded stem for engagement with an internally threaded receptacle.

7. A traction cleat in accordance with claim 1, wherein (i) the flange member includes a plurality of apetures; and (ii) the plastic skirt is dish-shaped, having concave and convex sides, and wherein the engagement means extends from the concave said thereof and the head portion extends from the convex side thereof, and wherein the plastic skirt contains a plurality of apertures in communication with the apetures of the flange member.

* * * * *